US007595793B2

(12) United States Patent
Hidaka

(10) Patent No.: US 7,595,793 B2
(45) Date of Patent: Sep. 29, 2009

(54) PLAIN DISPLAY APPARATUS, DISPLAY CONTROL CIRCUIT AND DISPLAY CONTROL METHOD, THAT DIVIDE PLURAL SIGNAL LINES IN BLOCKS

(75) Inventor: Kiyoshi Hidaka, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 625 days.

(21) Appl. No.: 11/341,522

(22) Filed: Jan. 30, 2006

(65) Prior Publication Data

US 2006/0187162 A1 Aug. 24, 2006

(30) Foreign Application Priority Data

Jan. 31, 2005 (JP) ..... 2005-023889

(51) Int. Cl.
*G09G 5/00* (2006.01)

(52) U.S. Cl. ..... 345/204; 345/98

(58) Field of Classification Search ..... 345/87–89, 345/98–100, 204, 211–213, 690
See application file for complete search history.

(56) References Cited

U.S. PATENT DOCUMENTS 5,062,001 A * 10/1991 Farwell et al. ..... 348/761
6,310,591 B1 10/2001 Morgan et al.
6,559,857 B2 5/2003 Ali-Santosa et al.
6,563,483 B1 * 5/2003 Sakumoto ..... 345/98
6,833,837 B2 12/2004 Hei La
7,084,844 B2 * 8/2006 Yeo et al. ..... 345/88
7,193,593 B2 * 3/2007 Koyama et al. ..... 345/87
7,268,756 B2 * 9/2007 Koyama et al. ..... 345/87
2003/0011581 A1 * 1/2003 Tanaka et al. ..... 345/204
2004/0179014 A1 * 9/2004 Nakano et al. ..... 345/501
2004/0263540 A1 * 12/2004 Ooishi et al. ..... 345/690
2005/0035934 A1 * 2/2005 Kitani et al. ..... 345/87
2005/0219276 A1 * 10/2005 Nose et al. ..... 345/690

FOREIGN PATENT DOCUMENTS

TW 540020 7/2003

* cited by examiner

*Primary Examiner*—Sumati Lefkowitz
*Assistant Examiner*—Rodney Amadiz
(74) *Attorney, Agent, or Firm*—Oblon, Spivak, McClelland, Maier & Neustadt, L.L.P.

(57) ABSTRACT

A plain display apparatus has a plurality of display elements formed in vicinity of signal lines and scanning lines disposed in a matrix form, and a signal line drive circuit which switches order of supplying pixel data to the signal lines at random for each horizontal line.

16 Claims, 5 Drawing Sheets

| COUNT VALUE | RANDOM VALUE |
|---|---|
| 0 | 052341 |
| 1 | 534102 |
| 2 | 203154 |
| 3 | 240351 |
| 4 | 321540 |
| 5 | 450231 |
| 6 | 530142 |
| 7 | 025431 |
| 8 | 041235 |
| 9 | 502314 |
| 10 | 524310 |
| 11 | 043251 |
| 12 | 325140 |
| 13 | 201435 |
| 14 | 501423 |
| 15 | 024531 |
| 16 | 510342 |

PLAIN DISPLAY APPARATUS, DISPLAY CONTROL CIRCUIT AND DISPLAY CONTROL METHOD, THAT DIVIDE PLURAL SIGNAL LINES IN BLOCKS

CROSS REFERENCE TO RELATED APPLICATIONS

This application is based upon and claims the benefit of priority from the prior Japanese Patent Application No. 2005-23889, filed on Jan. 31, 2005, the entire contents of which are incorporated herein by reference.

BACKGROUND OF THE INVENTION

1. Field of the Invention

The present invention relates to a plain display apparatus, a display control circuit and a display control method which divides a plurality of signal lines into blocks and drives the signal lines in units of each block.

2. Related Art

A liquid crystal display which divides a plurality of signal lines into blocks and drives each block by time sharing is known. In such a conventional liquid crystal display, each signal line in the blocks is driven at a constant cycle, and analog switches connected to the signal lines are turned on/off at a constant cycle to drive the signal lines.

However, if a cycle of driving each signal line in the block is constant, the signal lines and the other components function as an antenna, and a high-frequency noise may occur.

SUMMARY OF THE INVENTION

According to one embodiment of the present invention, a plain display apparatus, comprising:

a plurality of display elements formed in vicinity of signal lines and scanning lines disposed in a matrix form; and a signal line drive circuit which switches order of supplying pixel data to the signal lines at random for each horizontal line.

Furthermore, according to one embodiment of the present invention, a display control circuit according to claim 10, wherein the random number generating circuit includes:

a prime number counter which conducts a count operation by using a certain prime number as a reference; and a random value output circuit which outputs random values different from each counter value of the prime number counter, wherein the order setting circuit sets the order that the pixel data switching circuit supplies the pixel data to the signal lines in each block based on the random values.

DETAILED DESCRIPTION OF THE INVENTION

Hereafter, a plain display apparatus according to the present invention will be described more specifically with reference to the drawings.

FIRST EMBODIMENT

Figure 1:
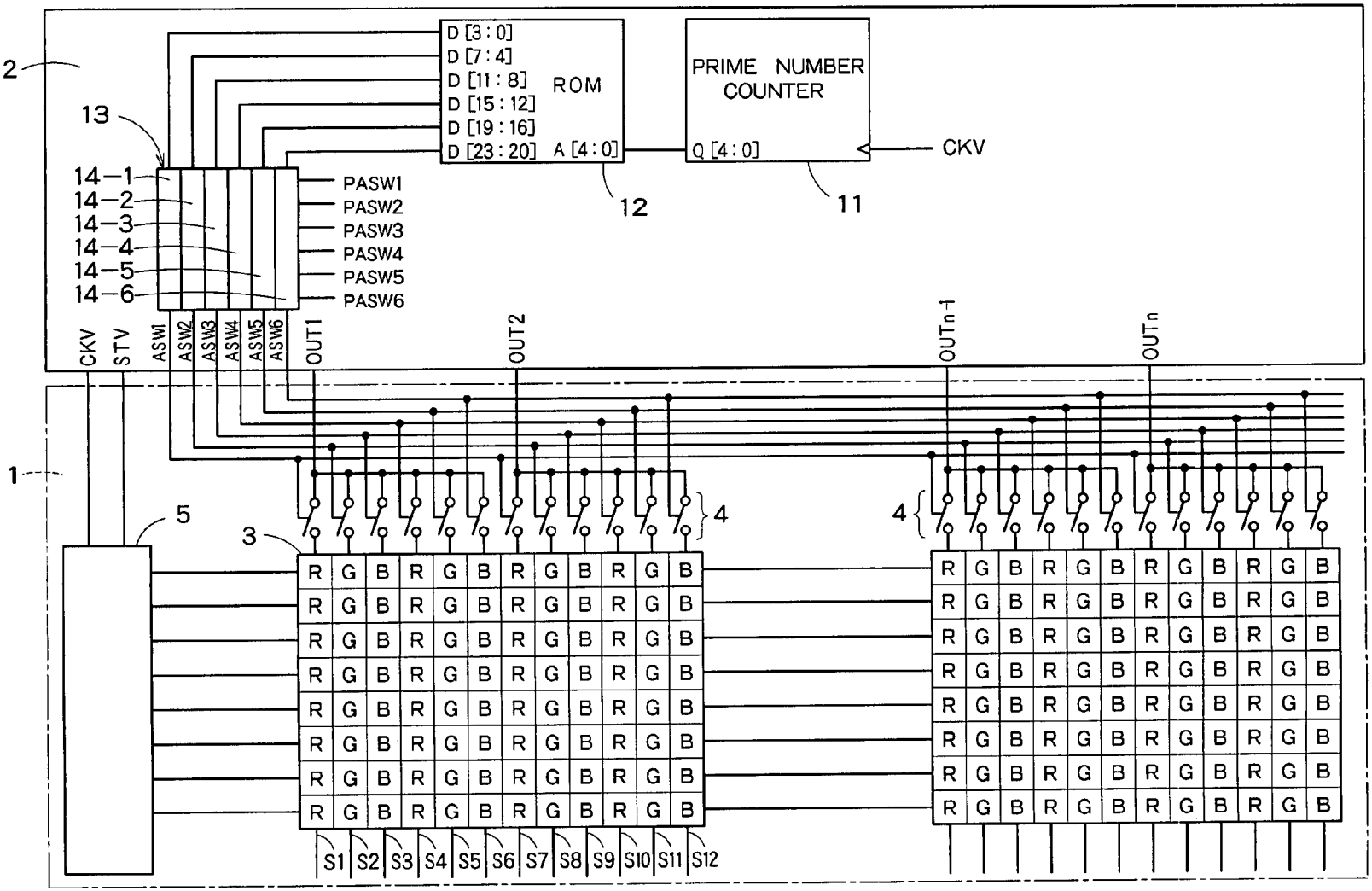
FIG. 1 is a block diagram showing a schematic configuration of a plain display apparatus according to a first embodiment according to the present invention.

FIG. 1 is a block diagram showing a schematic configuration of a plain display apparatus according to a first embodiment according to the present invention. Hereinafter, a liquid crystal display will be described as one example of the plain display apparatus.

The liquid crystal display of FIG. 1 has a LCD (Liquid Crystal Display) panel 1 formed on a glass substrate, and a LCD driver 2 implemented on a glass substrate, or implemented on a control substrate connected via an FPC (Flexible Print Circuit) on the glass substrate.

The LCD panel 1 has signal lines and scanning lines disposed in a matrix form, display elements 3 disposed in vicinity of cross points of the signal lines and the scanning lines, analog switches 4 connected to the respective signal lines, and a gate drive circuit 5 which drives the scanning lines. The display elements are, for example, pixel TFTs (Thin Film Transistors).

In the present embodiment, a block driving is conducted in units of the signal lines for two pixels (in total six signal lines, because one pixel has three signal lines for RGB), and different blocks are simultaneously driven. Six signal lines in each block are driven by time division in sequence. Accordingly, all the blocks simultaneously drive the corresponding one signal line, respectively.

The above-mentioned analog switches 4 are provided corresponding to the respective signal lines in the blocks. That is, six analog switches 4 are provided for each block, and each analog switch 4 is connected to the corresponding signal line.

Among six analog switches 4 in the same block, only one analog switch is turned on, and the signal lines connected to the turned-on analog switches 4 is supplied with the pixel data from the LCD driver 2. The pixel data is supplied from the LCD driver 2 to the respective blocks via the pixel data lines OUT1 to OUTn. The pixel data lines OUT1 to OUTn are provided for each block.

The LCD driver 2 has a prime number counter 11 which conducts a count operation for a number of times corresponding to a certain prime number, an ROM 12 which outputs a random value corresponding to a counter value of the prime number counter 11, and a switch controller 13 which controls ON/OFF of the analog switches 4 based on the random value outputted from the ROM 12. The switch controller 13 has six selectors 14-1 to 14-6 having the same circuit configuration. The selectors 14-1 to 14-6 are provided corresponding to the respective analog switches 4, and control ON/OFF of the corresponding analog switch 4, respectively.

The prime number counter 11 may be an up-counter, otherwise a down-counter. The prime number counter 11 conducts a count operation for a number of times corresponding to a certain prime number (for example, 17) in sync with a clock CKV having a cycle of one horizontal line. Hereinafter, an example in which the up-counter (heptadecimal line counter) is used as the prime number counter 11 will be described, and it is assumed that the count operation is conducted from 0 to 16.

Figures 2, 3:
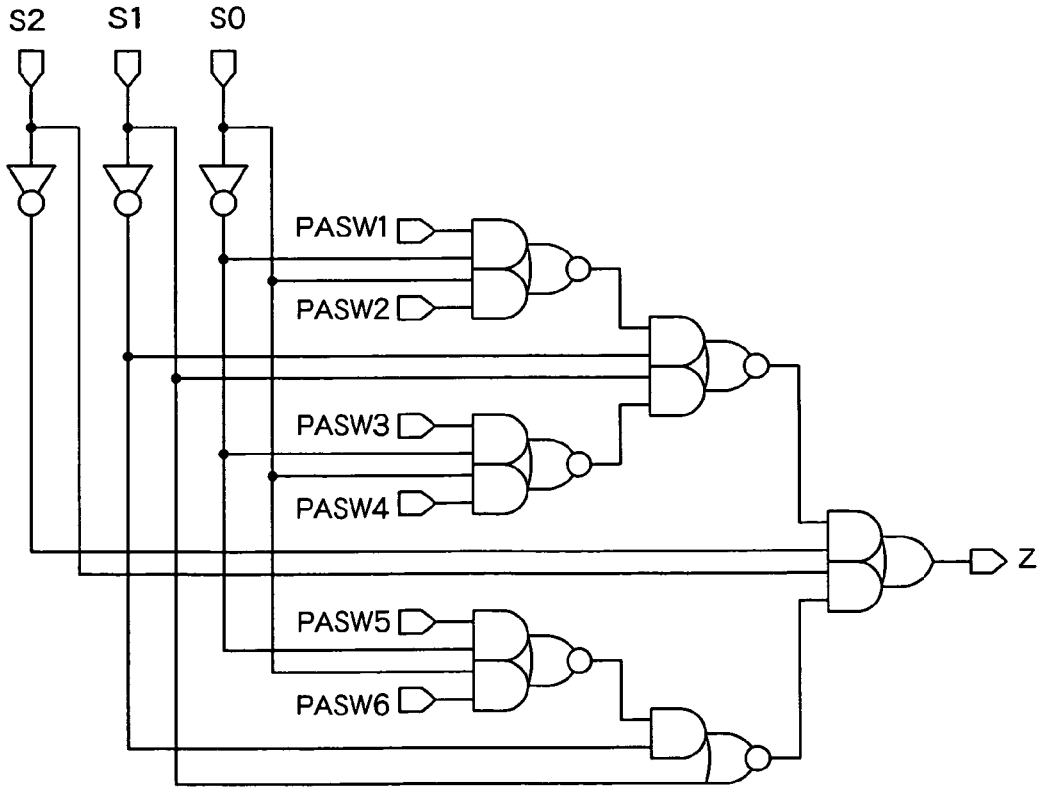
FIG. 2 is a diagram showing one example of data stored in the ROM 12.
FIG. 3 is a circuit diagram showing one example of concrete configurations of the selectors 14-1 to 14-6.

The ROM 12 stores a random value corresponding to the count value of the prime counter 11. FIG. 2 is a diagram showing one example of data stored in the ROM 12. A word length of the random value is sufficient with 18 bits. In this embodiment, in order to simplify data configuration of the ROM 12, the word length is set to 24 bits. The random value D[23:0] of 24 bits is divided to bit strings with the respective 4 bits. The bit strings are inputted to the corresponding selectors 14-1 to 14-6, respectively. More specifically, the random value D[3:0] is inputted to the selector 14-1, the random value D[7:4] to the selector 14-2, the random value D[11:8] to the selector 14-3, the random value D[15:12] to the selector 14-4, the random value D[19:16] to the selector 14-5, and the random value D[23:20] to the selector 14-6.

The selectors 14-1 to 14-6 control ON/OFF of the analog switches based on a partial bit string of the random values with 24 bits and pixel writing timing signals [PASW1:PASW6] which prescribe writing timings of the signal lines.

FIG. 3 is a circuit diagram showing one example of concrete configurations of the selectors 14-1 to 14-6. Among the bit strings of 4 bits outputted from the ROM 12, only lower 3 bits are inputted to the selectors 14-1 to 14-6. FIG. 3 expresses these 3 bits as S0, S1 and S2. The selectors 14-1 to 14-6 conduct logical operations with the bit string [S0:S2] and the pixel writing timing signals [PASW1:PASW6] to set a timing when the output Z become "1". When the output Z of any of the selectors 14-1 to 14-6 becomes "1", the analog switch 4 corresponding to the selector turns on.

As shown in FIG. 1, the switch controller 13 controls ON/OFF of the analog switches 4 in all the blocks. More specifically, the selectors 14-1 to 14-6 in the switch controller 13 control ON/OFF of the analog switches corresponding to all the blocks. As described above, it is possible to simplify a circuit configuration by sharing the switch controller 13 with all the blocks.

Figure 4:
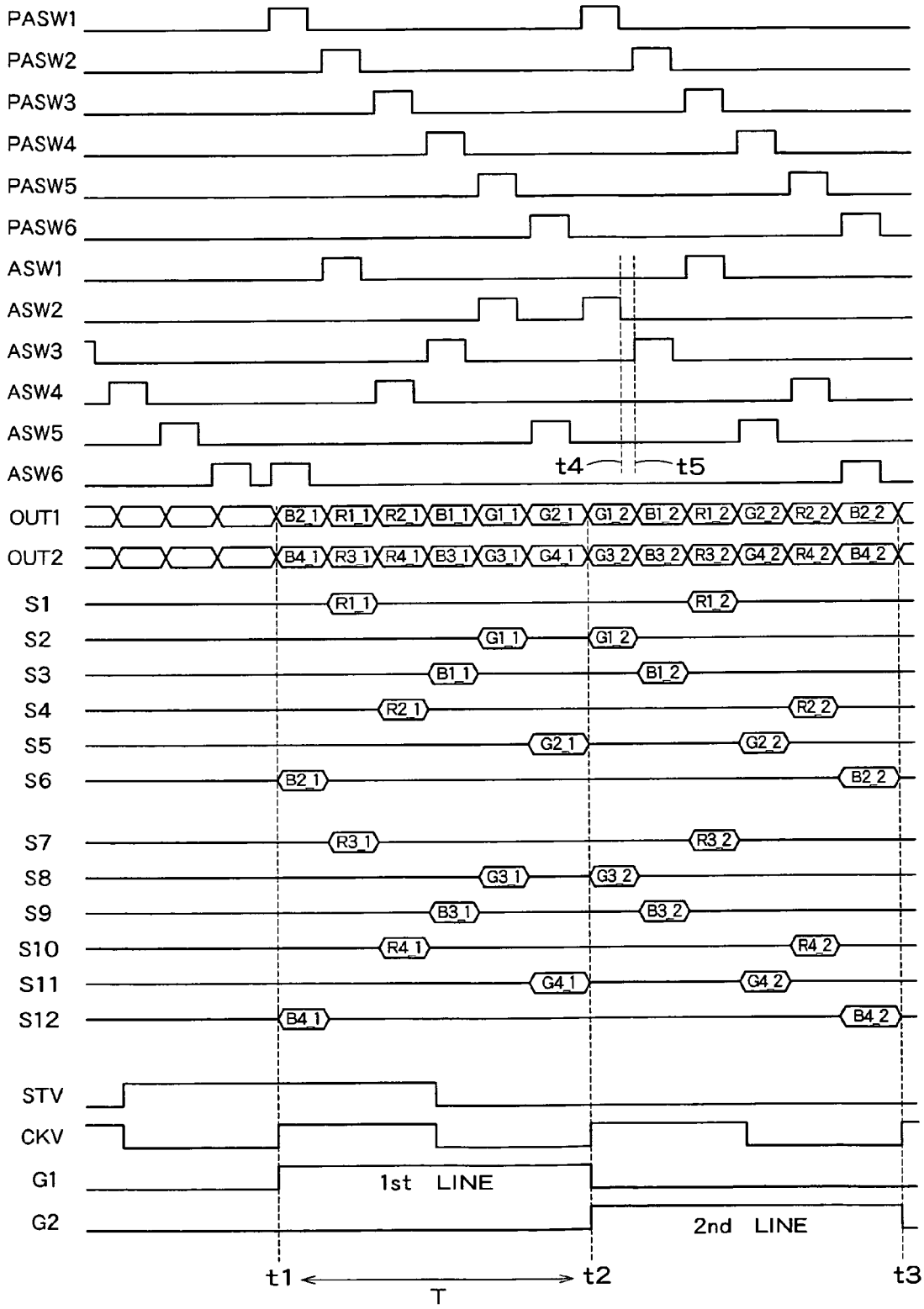
FIG. 4 is a diagram showing operational timings at a plurality of nodes in FIG. 1.

FIG. 4 is a diagram showing operational timings at a plurality of nodes in FIG. 1. The pixel writing timing signals [PASW1:PASW6] are signals with one horizontal line cycle T, and have phases staggered to each other. More specifically, the pixel writing timing signals have phases staggered for every (one horizontal cycle T/6).

Each pixel data lines are supplied with the RGB data for two pixels during one horizontal line cycle T (time t1 to t2). FIG. 4 shows an example in which the pixel data line OUT1 is supplied with blue data of second pixel B2_1, red data of first pixel R1_1, red data of second pixel R2_1, blue data of first pixel B1_1, green data of first pixel G1_1 and green data of second pixel G2_1 are supplied in order during a first horizontal line period (time t1 to t2). In this case, blue data of second pixel B2_1 supplied firstly is supplied to the signal line S6, red data of first pixel R1_1 is subsequently supplied to the signal line S1, red data of second pixel R2_1 is subsequently supplied to the signal line S4, blue data of first pixel B1_1 is subsequently supplied to the signal line S3, and green data of first pixel G1_1 is lastly supplied to the signal line S2.

During subsequent horizontal line period (time t2 to t3), the pixel data line OUT_1 is supplied with green data of first pixel G1_2, blue data of first pixel B1_2, red data of first pixel R1_2, green data of second pixel G2_2, red data R2_2 of second pixel R2_2, and blue data of second pixel B2_2. In this case, green data of first pixel G1_2 supplied firstly is supplied to the signal line S2, blue data of first pixel B1_2 is subsequently supplied to the signal line S3, red data of first pixel R1_2 is subsequently supplied to the signal line S1, green data of second pixel G2_2 is subsequently supplied to the signal line S5, red data of second pixel R2_2 is subsequently supplied to the signal line S4, and blue data of second pixel B2_2 is lastly supplied to the signal line S6.

As apparent from FIG. 4, order of driving the signal lines in the block is different for each horizontal line. The order of driving the signal lines depends on the random values outputted from the ROM 12.

The blocks different from each other are simultaneously driven. For example, as shown in FIG. 4, the pixel data on the pixel data line OUTn is supplied at the same timing as that of the pixel data on the pixel data line OUT1, and a timing written to the signal lines is also the same.

As described above, the signal lines are divided into a plurality of blocks and the pixel data is written to the signal lines in the respective blocks at the same timing according to this embodiment. Therefore, it is possible to lower the frequency of the pixel data lines and the writing frequency of the signal lines. It is possible to reduce the power consumption and to heighten display resolution, because a margin of frequency increases.

In the present embodiment, a value of the prime number counter 11 is updated for each one horizontal line, and in response to that, different random value is outputted from the ROM 12. A switching order of the analog switch 4 in the block changes at random based on the random value. Therefore, a periodicity is lost in drive waveforms of the signal lines, and the high frequency noise generated from the signal lines can be reduced.

If the value of the prime counter 11 is the same value, the ROM 12 always outputs the same value. At that time, the switching order of the analog switches 4 is also the same. However, the cycle of switching the analog switches 4 depends on the prime number of the prime number counter 11 and the number of display lines. Therefore, the writing order of consecutive two frames is not the same, and a periodicity is lost in drive waveforms of the signal lines for every frame.

Figure 5:
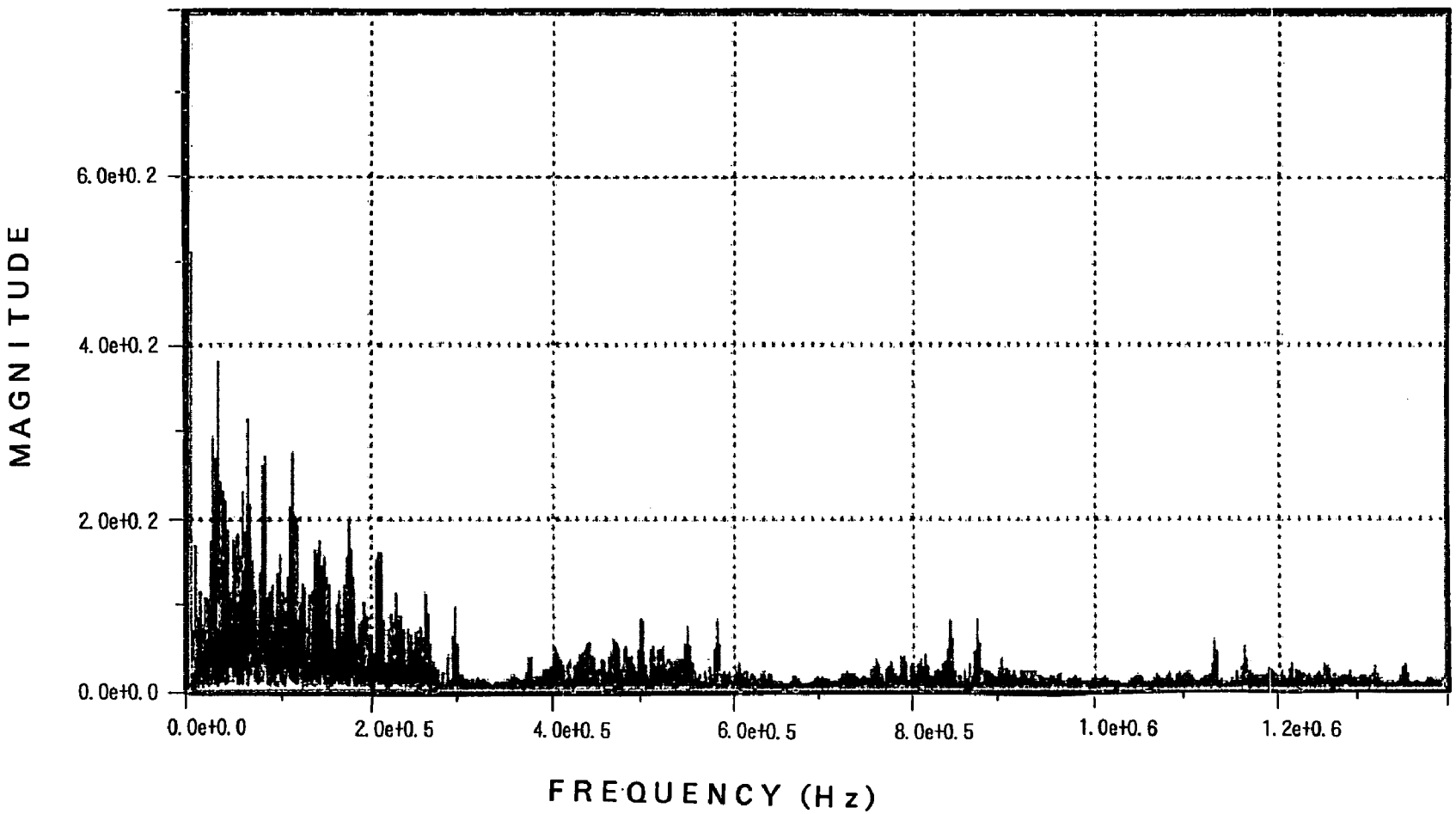
FIG. 5 is an FFT waveform diagram showing one example of unwanted radio waves emitted from the liquid crystal display of FIG. 1.
Figure 6:
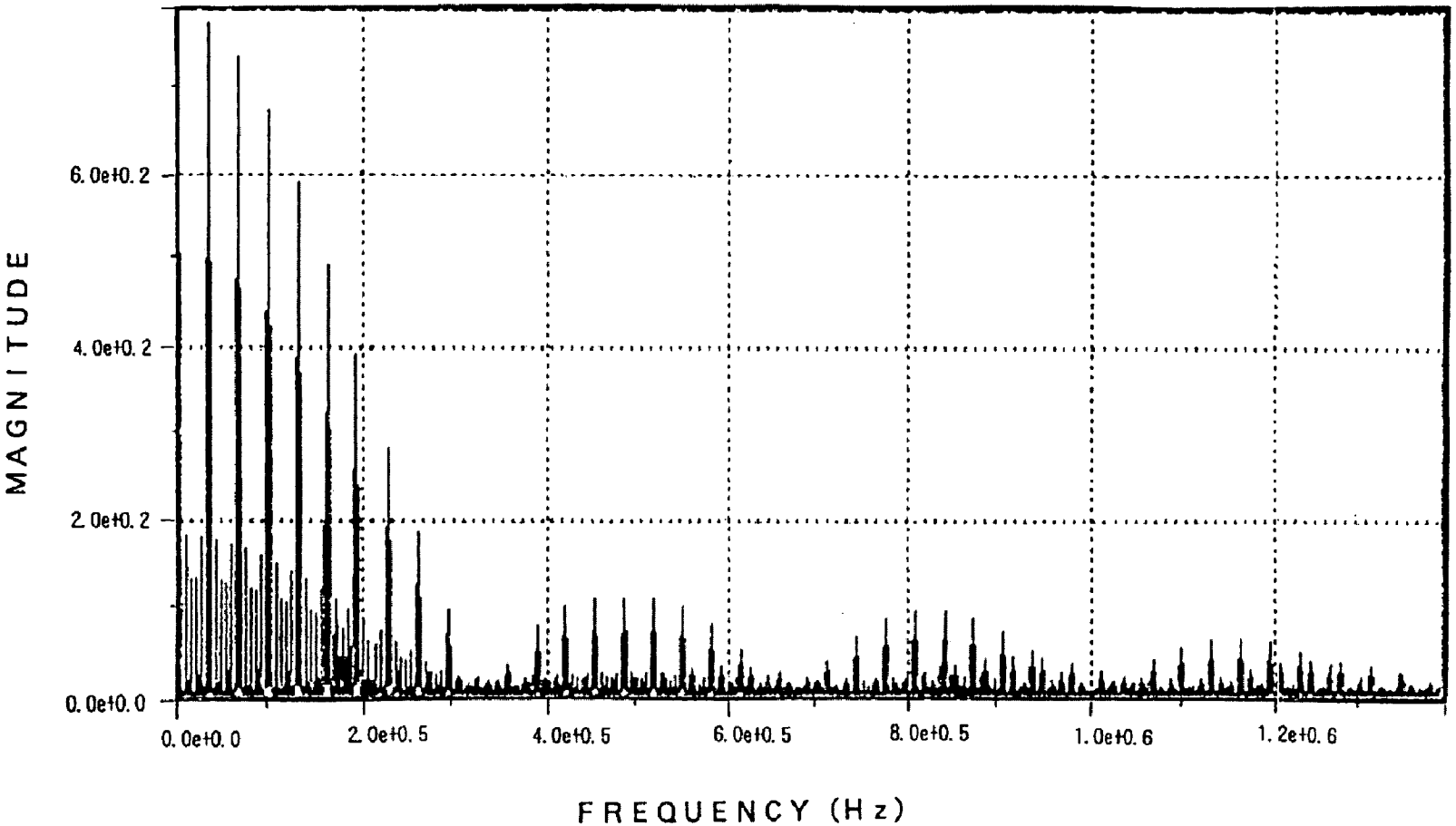
FIG. 6 CONVENTIONAL ART
FIG. 6 is an FFT waveform diagram showing a comparison example of unwanted radio waves emitted from the conventional liquid crystal display.

FIG. 5 is an FFT waveform diagram showing one example of unwanted radio waves emitted from the liquid crystal display of FIG. 1. FIG. 6 is an FFT waveform diagram showing a comparison example of unwanted radio waves emitted from the conventional liquid crystal display. In these drawings, a horizontal axis expresses frequency, and a vertical axis expresses signal strength. As apparent from FIGS. 5 and 6, according to the configuration of the present invention, it is possible to largely decrease emission of unwanted radio wave.

When the present embodiment switches ON/OFF of six analog switches 4 in each block, a period that all the analog switches 4 turn off is provided so that a plurality of analog switches 4 do not instantaneously turn on at the same time (see time t4 to t5 of FIG. 4). It is possible to prevent interference of pixel data by providing such an OFF period. Therefore, it is possible to prevent interference of different pixel data, and image quality is not deteriorated.

As described above, according to the present embodiment, the prime number counter 11 and the ROM 12 are used to randomize the writing order of the signal lines for each horizontal line and prevent the writing order of the signal lines from becoming equal in consecutive two frames. Therefore, it is possible to reduce the high frequency noise generated from the signal lines and to realize the liquid crystal display with a little unwanted radio wave emission.

Although the above embodiment has generated the random value by using the prime number counter 11 and the ROM 12, the random value may be generated by using a random (or pseudo-random) number generating circuit.

Although the above embodiment has written pixel data to the signal lines by treating the neighboring two pixels as one block, units of block is not limited. In accordance with units of block, the number of the analog switches 4 may be adjusted. In the above embodiment, although one example of implementing the LCD driver on the glass substrate has been described, the LCD driver 2 may be formed on the glass substrate in a unified manner by using poly-silicon process and so on.

The prime number counted by the prime number counter 11 is not limited. As the prime number is large, regularity is decreased, thereby reducing unwanted radio wave more effectively. Furthermore, the number of gradations of the pixel data outputted from the pixel data lines OUTn is not limited.

In the above embodiment, although an example of applying the present invention to the liquid crystal display has been described, the present invention is widely also applicable to an EL (Electroluminescense) apparatus and a PDP (Plasma Display Panel)

What is claimed is:

1. A plain display apparatus, comprising:

a plurality of display elements formed in vicinity of signal lines and scanning lines disposed in a matrix form; and a signal line drive circuit which switches order of supplying pixel data to the signal lines at random for each horizontal line, wherein the signal line drive circuit includes:

a pixel data switching circuit which controls switching of whether the pixel data is supplied to the signal lines in each block having a pluralitly of signal lines;

a random number generating circuit which generates the random numbers or the pseudo-random numbers; and an order setting circuit which sets the order that the pixel data switching circuit supplies pixel data to the signal lines in each block based on the random numbers or the pseudo-random numbers generated by the random generating circuit; and wherein the random number generating circuit includes:

a prime number counter which conducts a count operation by using a certain prime number as a reference; and a random value output circuit which outputs random values different from each counter value of the prime number counter;

wherein the order setting circuit sets the order that the pixel data switching circuit supplies the pixel data to the signal lines in each block based on the random values.

2. A plain display apparatus according to claim 1, wherein the random generating circuit generates the random number or the pseudo-random number for each horizontal line of a display region.

3. A plain display apparatus according to claim 1, wherein the prime number counter conducts a count operation in sync with clocks having a cycle of one horizontal line.

4. A plain display apparatus according to claim 1, wherein the random value output circuit includes a storage which stores the random values corresponding to the counter values of the prime number counter.

5. A plain display apparatus according to claim 1, wherein the prime number counter conducts the count operation for each horizontal line;

the pixel data switching circuit is provided for each block; and all the pixel data switching circuits simultaneously control switching of the signal lines based on the order set by the order setting circuit.

6. A plain display apparatus according to claim 1, wherein the pixel data switching circuit includes a plurality of analog switches connected to the signal lines in each block; and the order setting circuit sets ON/OFF timing of the analog switches based on write timing signals indicating write timings of the signal lines and the random values.

7. A plain display apparatus according to claim 6, wherein the write timing signals include a plurality of pulse signals which have a cycle of one horizontal line, and has pulses generated at timing different from each other; and the plurality of analog switches conduct ON/OFF operation in sync with a pulse generating timing of the corresponding pulse signal.

8. A display control circuit, comprising:

a pixel data switching circuit which controls switching of whether pixel data is supplied to signal lines in each block having a plurality of signal lines;

a random generating circuit which generates random numbers or pseudo-random numbers for each horizontal line of a display region; and an order setting circuit which sets order that the pixel data switching circuit supplies the pixel data to the signal lines in each block, wherein the random number generating circuit includes:

a prime number counter which conducts a count operation by using a certain prime number as a reference; and a random value output circuit which outputs random values different from each counter value of the prime number counter, wherein the order setting circuit sets the order that the pixel data switching circuit supplies the pixel data to the signal lines in each block based on the random values.

9. A display control circuit according to claim 8, wherein the random generating circuit generates the random number or the pseudo-random number for each horizontal line of a display region.

10. A display control circuit according to claim 8, wherein the prime number counter conducts a count operation in sync with clocks having a cycle of one horizontal line.

11. A display control circuit according to claim 8, wherein the random value output circuit includes a storage which stores the random values corresponding to the counter values of the prime number counter.

12. A display control circuit according to claim 8, wherein the prime number counter conducts the count operation for each horizontal line;

the pixel data switching circuit is provided for each block; and all the pixel data switching circuits simultaneously control switching of the signal lines based on the order set by the order setting circuit.

13. A display control circuit according to claim 8, wherein the pixel data switching circuit includes a plurality of analog switches connected to the signal lines in each block; and the order setting circuit sets ON/OFF timing of the analog switches based on write timing signals indicating write timings of the signal lines and the random values.

14. A display control circuit according to claim 13, wherein the write timing signals include a plurality of pulse signals which have a cycle of one horizontal line, and has pulses generated at timing different from each other; and the plurality of analog switches conduct ON/OFF operation in sync with a pulse generating timing of the corresponding pulse signal.

15. A display control method, comprising:

controlling switching of whether pixel data is supplied to signal lines in each block having a plurality of signal lines;

generating random numbers or pseudo-random numbers for each horizontal line of a display region; and setting order of supplying the pixel data to the signal lines in each block based on the generated random number and pseudo-random number;

wherein when generating the random number or the pseudo-random number, the random values different from count values of a prime number counter which conducts a count operation by using a certain prime number as a reference is outputted; and the order of supplying the pixel data to the signal lines in each block is set based on the random values.

16. A display control method according to claim 15, wherein the prime number counter conducts a count operation for each horizontal line; and all the blocks conduct in parallel processings for setting the order of supplying the pixel data to the signal lines in each block based on the generated random number or the pseudo-random number.

* * * * *